US005640144A

United States Patent [19]

Russo et al.

[11] Patent Number: 5,640,144

[45] Date of Patent: Jun. 17, 1997

[54] RF/ULTRASONIC SEPARATION DISTANCE ALARM

[75] Inventors: Francesco Russo, Vermezzo; Giovanni Mondani, Milan, both of Italy

[73] Assignee: MATRIX S.A.S. di G. De Zorzi ec., Vermezzo, Italy

[21] Appl. No.: 545,311

[22] Filed: Oct. 19, 1995

[51] Int. Cl.[6] ..... G08B 13/16; G08B 13/22

[52] U.S. Cl. ..... 340/568; 340/531; 340/539; 340/571

[58] Field of Search ..... 340/568, 531, 340/539, 571

[56] References Cited

U.S. PATENT DOCUMENTS

| | | | |
|---|---|---|---|
| 4,675,656 | 6/1987 | Narcisse | 340/539 |
| 4,843,371 | 6/1989 | Kuei et al. | 340/539 |
| 5,099,226 | 3/1992 | Andrews | 340/572 |
| 5,402,104 | 3/1995 | LaRosa | 340/539 |

FOREIGN PATENT DOCUMENTS

| | | |
|---|---|---|
| 596622 | 3/1978 | Switzerland . |
| 9325983 | 12/1993 | WIPO . |
| 9502874 | 1/1995 | WIPO . |

OTHER PUBLICATIONS

Abstract of EP 139698.
Abstract of EP 528437.
Abstract of EP 494409.

*Primary Examiner*—Glen Swann

[57] ABSTRACT

An alarm system for preventing loss or theft of one or more articles includes an ultrasonic transmitter incorporated in the article(s) to be protected, and a monitoring unit provided with a receiver for receiving the ultrasonic signal from said transmitter and triggering an alarm, for example when the distance between the receiver and transmitter exceeds a predetermined value. The monitoring unit periodically interrogates the protected articles by transmitting a coded RF signal which is decoded and identified by the protecting device of the concerned article, the article emitting an ultrasonic coded signal in response. The ultrasonic coded signal is received by the monitoring unit and triggers an alarm when predetermined conditions are met. Two receiving channels can be arranged in space diverse relationship for better receiving the ultrasonic signal, and the distance between the monitoring unit and the article to be protected can be adjusted.

11 Claims, 4 Drawing Sheets

RF/ULTRASONIC SEPARATION DISTANCE ALARM

BACKGROUND OF THE INVENTION

1. Field of the Invention

The present invention relates to an alarm system for preventing loss or theft of one or more articles. More particularly the system of the invention can be used in preventing loss of wallets or other valuable personal articles, as well as in the surveillance of items that can be moved, e.g. for being used, but not taken away, as it happens for example in respect of government or notary's seals.

2. Description of Related Art

From EP-A-0 139 698 it is known a reminder alarm system for preventing loss of articles which provides several emitters transmitting signals to a receiver/alarm sounder, with each emitter triggering the alarm signal as soon as the signal from it goes below a predetermined level, depending on the distance therebetween.

U.S. Pat. No. 4,843,371 discloses a burglar alarm system comprising a portable wireless transmitter and a receiver mounted in a briefcase forming a distance-measuring device which triggers an alarm when the distance between the receiver and the transmitter exceeds the receiving range.

Anti-theft systems providing a tag attached to an article to be protected are also known, see for example EP-A-0 494 409.

A drawback of the known devices is that they do not provide reliable protection of both a single article and a plurality of articles with the same device.

Moreover the known systems used for protecting articles within a fixed area, such as articles in a wholesale store, cannot be used as a portable alarm system to be worn by a person for warning him of a theft, or as a simple reminder in case of inadvertent oversight.

On the other hand the known systems for preventing loss of portable articles and the anti-theft devices are unsuitable for protecting objects that are to be confined—and in case used—in a fixed area, such as seals in a notary's office.

Additional drawbacks of the known systems are that the power consumption of the tags or devices attached to the articles to be protected is not negligible and therefore the useful life of such tags is rather short.

Moreover in the known systems the range of protection cannot be adjusted, and the environment often renders unreliable their working.

The object of the present invention is to overcome the above mentioned limitations and shortcomings, and more particularly to provide a system that allows the simultaneous protection of a number of articles with an extremely low power consumption of the devices attached to the protected objects so that the protection is reliably ensured for a long time.

Moreover the invention aims to realize a system that is really flexible so that the same arrangement can be used for protecting a single article as well as a plurality of articles, or as an alarm system for preventing the loss or theft of one or more personal objects such as a wallet. This renders the system of the invention both inexpensive and reliable.

SUMMARY OF THE INVENTION

In accordance with the invention the above objects are achieved through an alarm system for preventing loss or theft of at least one article, comprising:

a transmitter located in a protection device or tag attached to or incorporated in said at least one article; and a monitoring unit provided with a receiver for receiving the signal from said transmitter and triggering an alarm when the distance between said receiver and transmitter exceeds a predetermined value;

said transmitter being an ultrasonic transmitter and said receiver being an ultrasonic receiver, and said monitoring unit further comprising an RF transmitter for periodically transmitting coded RF signals, and each protection device including an RF receiver and a logic unit for activating said ultrasonic transmitter in response to said coded RF signals.

Additional advantageous features are recited in the dependent claims.

The system of the invention provides a central monitoring unit equipped with an ultrasonic receiver and an RF transmitter which periodically interrogates the protection devices attached to or incorporated into each of the articles to be protected. Each of such devices is equipped with an ultrasonic transmitter and an RF receiver.

The RF transmitter is a low power transmitter and its carrier frequency is successively modulated by the codes associated to each one of the articles to be protected. Each protecting device includes a decoder for identifying the transmitted code and responding when the received code is equal to the one assigned to it and stored in a memory. Preferably the monitoring unit includes two receiving channel arranged in space diversity for better receiving the ultrasonic signals.

Since acoustic waves are used for responding to the interrogation, the distance between the central unit and the article to be protected is easily determined and the system can be precisely set for a given range of the allowable displacement.

In some applications of the invention the monitoring unit can be fixed and capable of recharging the power supply source (a rechargeable battery) incorporated in the protected article.

BRIEF DESCRIPTION OF THE DRAWINGS

The invention will be now described with reference to the attached drawings explanatory of preferred but not limiting embodiments of the invention, in which.

DETAILED DESCRIPTION OF THE PREFERRED EMBODIMENTS

Figure 1:
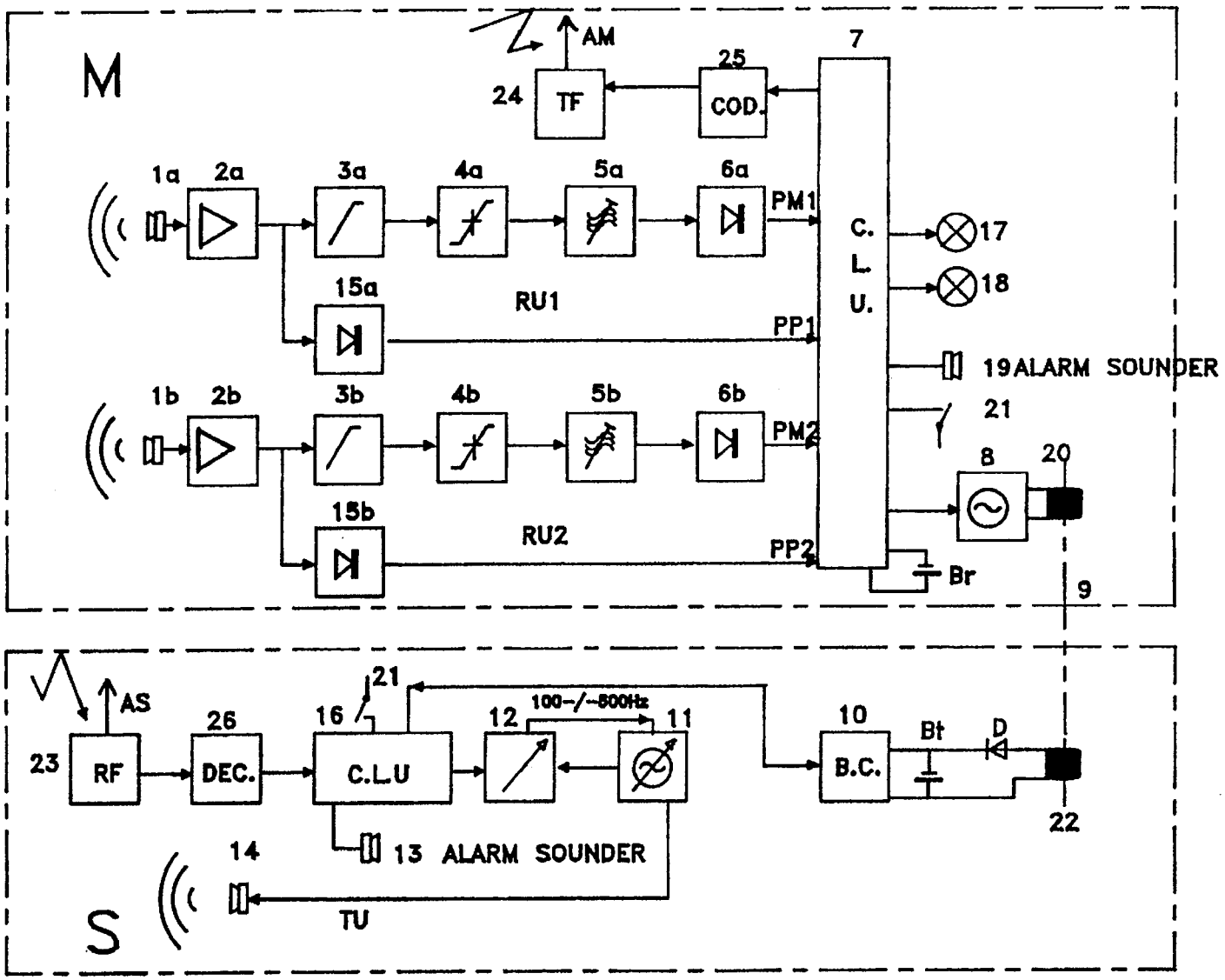
FIG. 1 is a block diagram of an embodiment of the present invention.

With reference to FIG. 1, which is a block diagram illustrating the general features of the invention, the system according to the present invention comprises a central monitoring unit M and at least one device S to be incorporated or otherwise attached to the article or articles to be protected. For simplicity sake, FIG. 1 shows a single protection device S, but a number of similar devices can be used at the same time, each attached to a corresponding article to be protected.

Each protecting device S includes an RF receiver 23 with an associated antenna AS, and connected to an decoder 26 which in turn is connected to a control logic unit 16, preferably of a type having a very low power consumption.

The protection device S further includes a variable oscillator 11 adapted to generate oscillations at ultrasonic frequencies, in the range about 40 kHz, which is modulated by a signal generated by a second (variable frequency) generator 12 the output of which is a frequency comprised within 100 and 500 Hz. The modulated output of the variable oscillator 11 drives an electroacoustic transducer 14, such as a piezoelectric transducer, capable of emitting an ultrasonic oscillation into the air.

The frequency or tone generated by the second generator 12 is set for being different for each of the articles to be protected, so that such frequency includes an information identifying a specific article. The above modulation is preferably a frequency modulation.

The device is fed by a small battery Bt supplying power to the above mentioned circuits through a control circuit 10 which in one embodiment of the invention applies to the control logic unit 16 an alarm when its output voltage falls below a given threshold.

Figure 3:
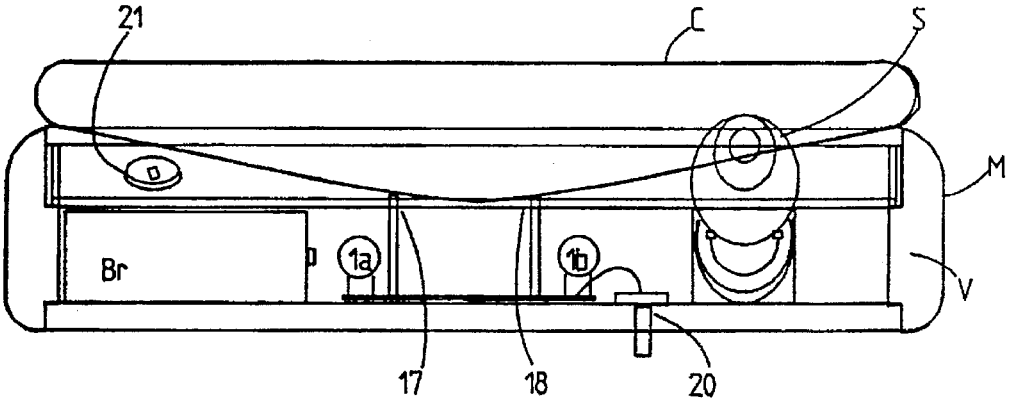
FIG. 3 illustrates the application of the invention in protecting a notary's seal.

In one embodiment of the invention, this latter is particularly suitable for protecting valuable objects that are to be used in a given area, but not to be removed therefrom, such as a set of notary's seals as the one illustrated in FIG. 3. In such applications the monitoring unit M is housed in a tamper-proof container which is secured to a wall or a desk, and in these cases the battery is preferably rechargeable. To this aim a charging circuit (see FIG. 1) comprising a coil 22 wound on a ferrite core and a diode D is connected in parallel to the battery Bt. The coil 22 is located inside a magnetic field generated by a coil 20 wound on a ferrite core too and connected to an oscillator 8, both of which are preferably located in the tamper-proof container. This way electric power is inductively transferred to the coil 22 which in turns charges the battery Bt through to the diode D. A drop in the battery output voltage below a predetermined value (e.g. 90% of the nominal voltage) can be detected by the control circuit 10 and a warning signal can be added to the acoustic modulated signal.

When the system of the invention is used for preventing the loss of personal objects such as wallets or the like, the battery is preferably a small size battery embedded in the tag and the device is such as to ensure a very long duration of the battery, as will be illustrated with more details. Further when protecting small personal properties such as wallets and the like, the device S incorporates a small sounder 13 for helping the owner in tracing the article.

Monitoring unit M comprises a control logic unit 7, an ultrasonic receiver, and an alarm sounder 19. LEDs 17 and 18 are provided for indicating the conditions of the monitoring unit, and a battery Br is provided for back-up operation and when the unit is movable, i.e. to be worn by the user.

The monitoring unit M is further equipped with means for radiating RF signals, comprising an aerial AM, an RF transmitter 24 and a coder 25 connected to the control logic unit 7.

As shown in the embodiment of FIG. 1, the sonic receiver comprises two receiving channels a and b that are substantially identical. In other embodiments of the invention where the operating environment is not severe, a single receiving channel can be used. Since the two channels are identical only one of them, namely channel a will be illustrated in the following, whereas the components of the other channel have been indicated by the same numeral references followed by suffix b.

Receiving channel a comprises an electroacoustic transducer, such as a piezoelectric transducer 1*a* which generates an electrical signal in response to the ultrasonic signal generated by transducer 14 of (one of) the device(s) S. The output of transducer 1*a* is connected to a low-noise preamplifier 2*a* and the output of the amplifier is applied both to a carrier detecting circuit 15*a* and to an amplifier 3*a* that limits the output level to a maximum predetermined value to prevent saturation. The output PP1 of the carrier detecting circuit 15*a* is directly applied to an input of the control logic unit 7, whereas the output of the limitating amplifier 3*a* is connected to a frequency discriminator 4*a* and the output of discriminator 4*a* is applied to a filter 5*a* that is tunable within the range 100–500 Hz. The output of filter 5*a* is connected to a circuit 6*a* for detecting the identifying note and emitting a signal PM1 indicating the presence of a modulation. The outputs of both detecting circuits 6*a* and 15*a*, respectively signals PM1 and PP1 for channel a and PM2 and PP2 for channel b, are applied to two pairs of inputs of the control logic unit 7.

The control logic unit 7 is capable of processing the signals PM1, PP1 and PM2, PP2 from the two pairs of detecting circuits 6*a*, 15*a* and 6*b*, 15*b* and actuate an alarm, for example an alarm sounder 19, when predetermined conditions are met.

When two receiving channels are used, the two transducers 1*a* and 1*b* are located in different positions on the container housing the monitoring unit M (see for example FIGS. 3 and 6), so as to receive acoustic signals coming from different directions, i.e. that have been differently reflected and followed different paths in the surrounding environment.

The space diversity arrangement proposed by the invention ensures that the unit M receives sufficiently strong identifying signals even when the object is placed at a point unfavorable in respect of the environment reflections.

The control logic unit 7 substantially performs a logical OR between the signals received through the two channels a and b, and actuates the sounder 19 when one or more of the following conditions are met:

No signals is received at all;

Both identifying codes of the two channels are not recognized.

The operating modes of control logic unit 7 are schematically illustrated by the following Table.

TABLE

| Channel a | | Channel b | | C Logic | |
|---|---|---|---|---|---|
| PP1 | PM1 | PP2 | PM2 | Td | Alarm output |
| 1 | 1 | X | X | 1 | 0 |
| X | X | 1 | 1 | 1 | 0 |
| 0 | X | 0 | X | 1 | 1 |
| X | 0 | X | 0 | 1 | 1 |
| X | X | X | X | 0 | 1 |

where

PP1=carrier frequency present on channel a

PM1=correct modulation detected on channel a

PP2=carrier frequency present on channel b

PM2=correct modulation detected on channel b

Td=ultrasonic signal received within a given time

1=present

0=missing

X=indifferent.

When the invention is applied to the protection of seals and the like, the sounder or other warning device 19 can be disabled by means of a suitable key 21, or by digiting a predetermined code on a keybord (not shown) in the housing.

When the invention is applied in preventing loss of personal objects such as wallets and the like, warning device 19 and can be disabled by means of a switch 21 controlled by a mechanical device 40 which fastens the unit M to the user/wearer. Means (not shown in details) are further provided for disabling the additional sounder 13 when this latter is provided for.

In all applications the warning device is further disabled by returning the protected object(s) within the allowed range.

The control logic unit 7 is preferably of the low power type when the invention is applied for protecting personal objects.

The working of the above illustrated system is the following.

Device S is usually in a stand-by (or sleep) condition requiring a very low power consumption. Periodically at the end of a randomly determined time interval, such as for example each 2 or 3 seconds, the control logic unit 7 transmits a coded RF signal which is received by the (or each of the) device(s) S. Of course, when more than one article is to be protected, control logic unit 7 will transmit a sequence of coded RF signals each corresponding to a particular one of the devices.

When this code is received and recognized by the logic unit 16, oscillator 11 is activated for a predetermined time interval in order to transmit for said time interval an ultrasonic signal modulated by the frequency of generator 12. More particularly, upon receiving the coded signal and identifying the code, logic unit 16 of the concerned device S activates the transducer 14 for emitting a response code signal, particularly a short duration pulse (for example 10–100 ms) containing the identification code. Thus the devices S are in a condition of low power consumption for most of the time.

According to whether this ultrasonic signal has been received or not within a maximum set delay corresponding to the maximum allowed distance, the alarm is activated or not.

Figure 2:
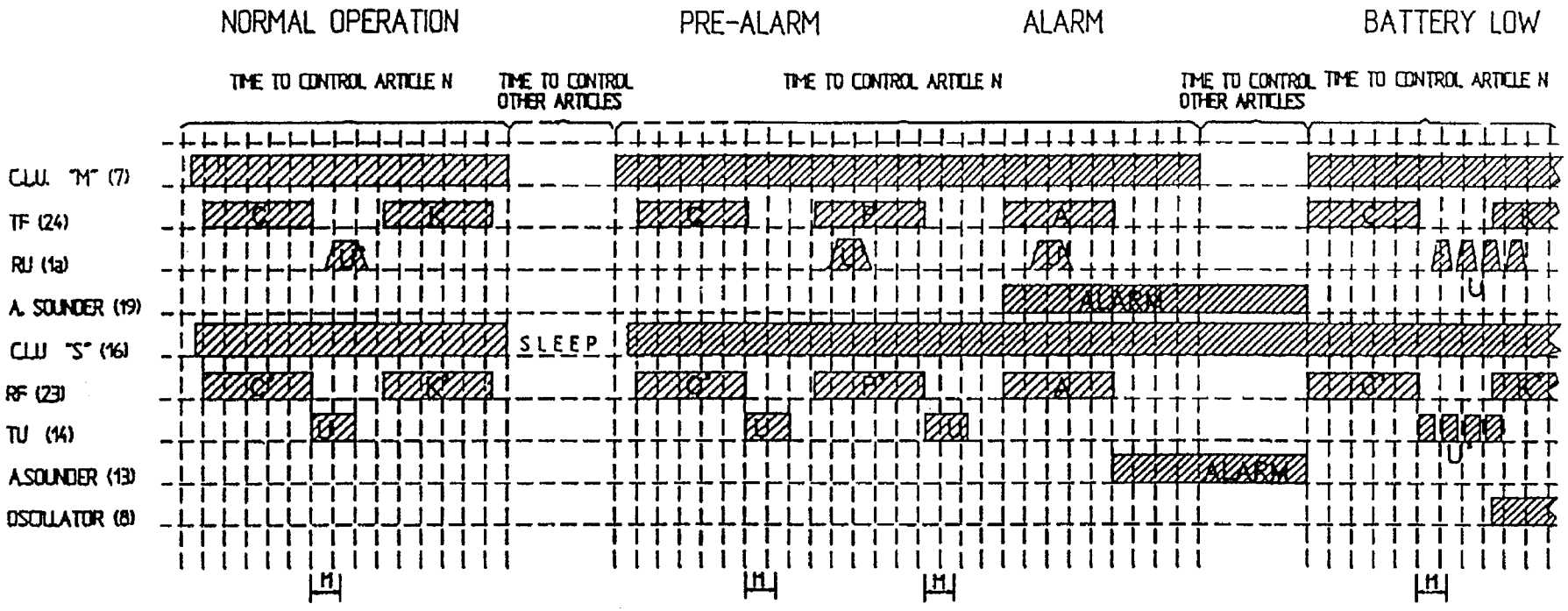
FIG. 2 shows the time diagrams illustrating the control operations.

The time charts of FIG. 2 illustrate with more details this working, with particular reference to the normal operation, pre-alarm, alarm and battery low states.

In the timing charts there are schematically shown the main events in the working of the system.

The diagrams meaning is explained below.

C.L.U. (7) state of the control logic unit 7

TF (24) state of the radio frequency transmitter 24

RU (1*a*) state of the ultrasonic receiver 1*a*

A.SOUNDER (19) state of alarm sounder 19

RF (23) state of the radio frequency receiver 23

TU (14) state of the ultrasonic transducer 14

A.SOUNDER (13) state of additional alarm sounder 13

OSCILLATOR (8) state of the battery charger oscillator 8.

In the diagrams an etched area indicates that the device is active and the capital letters in the active areas have the following meanings.

C=transmission of the interrogating RF signal from M to S.

C'=interrogation signal (including identifying code) correctly received.

U=transmission of ultrasonic modulated pulse from S to M.

U'=correct reception and detection of the ultrasonic modulated pulse by (at least) one of the channels a or b.

K=acknowledgement radio transmission of normal conditions and communication of the time interval of the next interrogation.

K'=correct reception of message K and switching to sleep condition.

SLEEP=very low consumption stand-by condition of device S for the time interval communicated by M.

P=radio re-transmission for interrogating device S.

P'=reception of P signal.

A=radio frequency transmission of the alarm state to S.

A'=reception of the alarm state.

t1=maximum delay allowed for receiving the ultrasonic signal (in the order of 3.3 msec/m, that is 3.3 milliseconds for each meter of distance allowed between M and S).

As shown in FIG. 2, the following four main conditions can be traced in the working of the systems.

NORMAL OPERATION in which the RF interrogation C from unit M is correctly received by device S (C') and causes a reply (U) which is correct both in respect of the time delay t1 and the identifying code.

PRE-ALARM in which the RF interrogation C causes a correct reply (U') which however is received after the allowed delay t1. The repeated interrogation P aims to prevent triggering false alarms due to radio disturbances.

ALARM in which even the re-interrogation P confirms that the distance between S and M is greater that the set value (determined by the value of t1). This confirmation causes the passage into alarm conditions and the actuation of sounder 19 of unit M and, after the radio communication, of tracing sounder 13. Alarm conditions can be reached also in case no interrogation (C') or confirmation (K') are received, unless the system has been previously disabled (system disabling is not shown in the diagrams).

BATTERY LOW in which a normal operating condition of the system has been reached due to the return of device S within the predetermined range, but a communication is present indicating that battery is partially discharged. In the system of FIG. 1 for protecting a seal and the like this condition automatically starts oscillator 8 for charging the battery.

Since the control logic unit 7 knows the response delay of the device S, mainly due to the delay introduced by the decoder, the control logic unit 7 can easily calculate the distance from the device S on the basis of the time elapsed between the end of the interrogation and the receiving of the response.

Thanks to the periodic switching into sleep state, the power consumption is extremely low and the battery incorporated in the device attached to the protected article has a duration in the order of at least one year.

FIG. 3 illustrates an embodiment of the invention applied in protecting a single notary's seal resting in a container provided with a disabling lock 21 and a tamper-proof member 20.

Figure 5:
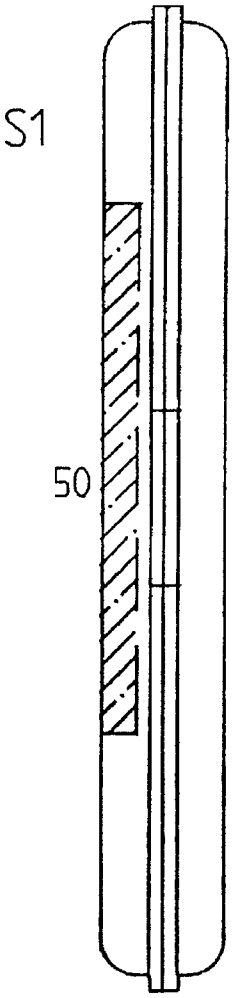
FIGS. 4 and 5 are a front view and a side view of an object to be protected.
Figure 4:
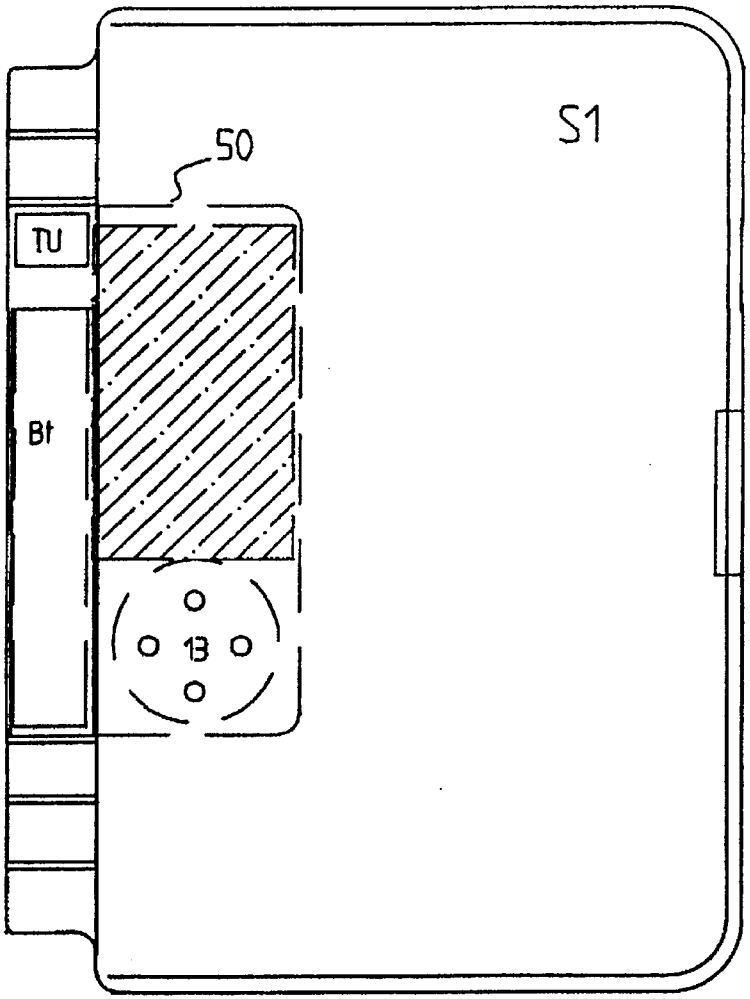

FIGS. 4 and 5 show a wallet or document holder housing a device S1 located in a space 50 also containing the battery Bt, the piezoelectric transducer TU and the additional sounder 13 for helping to trace the article in case the alarm has been triggered.

Figure 6:
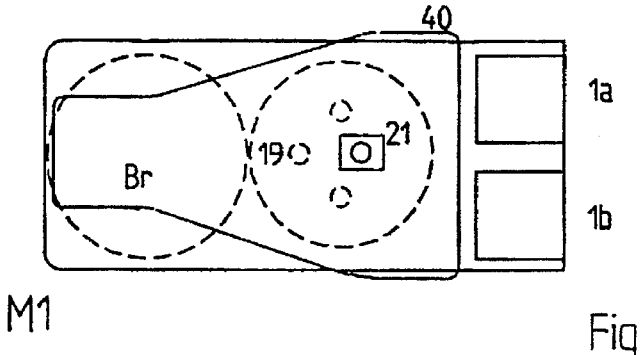
FIGS. 6 and 7 are a front view and a side view of a monitoring unit.
Figure 7:
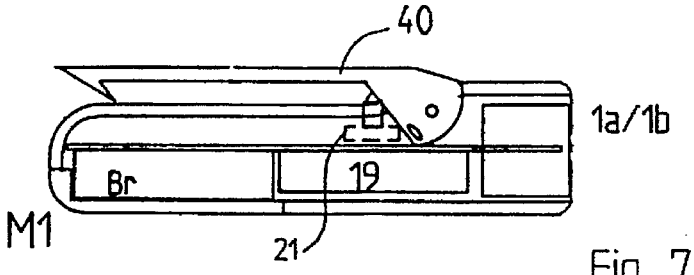

FIGS. 6 and 7 show a monitoring unit M1 to be worn by the user for preventing loss of personal objects, typically a wallet. The Figures show the battery Br, the alarm sounder 19 and the ultrasonic transducer(s) 1*a*/1*b*. There is further shown the already illustrated device 40 for safely securing the device to the user's pocket or briefcase in order to prevent it from being removed or stolen with the wallet. When device 40 is voluntarily opened for removing or transferring the unit, the switch 21 is activated and it starts the disabling procedure of the system.

Although the invention has been disclosed with reference to preferred embodiments, the invention is generally capable of applications and modifications that are to be included in the protective scope as will become apparent to the skilled of the art.

We claim:

1. An alarm system for preventing loss or theft of at least one article, comprising:

a transmitter located in a protection device or tag attached to or incorporated in said at least one article; and a monitoring unit provided with a receiver for receiving the signal from said transmitter and triggering an alarm when the distance between said receiver and transmitter exceeds a predetermined value, said transmitter being an ultrasonic transmitter and said receiver being an ultrasonic receiver, and said monitoring unit further comprising an RF transmitter for periodically transmitting coded RF signals, and each protection device including an RF receiver and a logic unit for activating said ultrasonic transmitter in response to said coded RF signals.

2. A system as claimed in claim 1, wherein said ultrasonic receiver comprises two substantially identical receiving channels having receiving transducers arranged in space diversity relationship, and a control logic unit for receiving the outputs of said receiving channels and triggering said alarm.

3. A system as claimed in claim 2, wherein said control logic unit of said ultrasonic receiver works according to the following table:

| Channel a | | Channel b | | C Logic | |
|---|---|---|---|---|---|
| PP1 | PM1 | PP2 | PM2 | Td | Alarm output |
| 1 | 1 | X | X | 1 | 0 |
| X | X | 1 | 1 | 1 | 0 |
| 0 | X | 0 | X | 1 | 1 |
| X | 0 | X | 0 | 1 | 1 |
| X | X | X | X | 0 | 1 |

where channels a and b correspond to the two receiving channels;

PP1=indicates a carrier frequency present on channel a;

PM1=indicates a correct modulation detected on channel a;

PP2=indicates a carrier frequency present on channel b;

PM2=indicates a correct modulation detected on channel b;

Td=indicates an ultrasonic signal received within a given time;

1=stands for present;

0=stands for missing; and

X=stands for indifferent.

4. A system as claimed in claim 1, wherein each receiving channel comprises an electroacoustic transducer connected to a low-noise preamplifier, the output of which is connected to a carrier detecting circuit and to a limiting amplifier, the output of said limiting amplifier being connected through a frequency discriminator in series with a tunable filter to a note detecting circuit, with the outputs of said carrier detecting circuit and note detecting circuit being input to said control logic unit.

5. A system as claimed in claim 1, wherein said monitoring unit is provided with a coder for sending an interrogation to the protection device which is decoded by a decoder of this latter for sending back said ultrasonic pulse, whereby the distance between the protection device and said monitoring unit can be calculated as a function of the time delay after which said monitoring unit receives said ultrasonic pulse.

6. A system as claimed in claim 1, wherein each one of said protecting devices includes an RF receiver connected to said logic unit through a decoder, a variable ultrasonic oscillator modulated by a second generator emitting a frequency between 100 and 500 Hz and different for each of the articles to be protected, said ultrasonic oscillator driving said ultrasonic transmitter.

7. A system as claimed in claim 1, wherein each of said protection devices is in a condition requiring a very low power consumption for most of the time and is periodically interrogated for emitting a response coded signal, the response coded signal including a short duration pulse containing an identification code of the device.

8. A system as claimed in claim 1, wherein the device to be protected includes a battery, and each of said protection devices includes a control circuit for the battery incorporated in the device to be protected.

9. A system as claimed in claim 8, wherein said battery is rechargeable and said control circuit is capable of detecting a drop of the battery output voltage and adding a warning signal to the ultrasonic modulated pulse whereby a device for charging said battery is activated, such device comprising a first coil wound on a ferrite core and a diode connected in parallel to the battery with said coil being inductively coupled with a second coil wound on a ferrite core too and connected to an oscillator, both of which are located in a tamper-proof container.

10. A system as claimed in claim 1, wherein said alarm activated in said monitoring unit comprises a sounder, and further wherein said protection device incorporates an additional sounder for tracing the protected article.

11. A system as claimed in claim 1, wherein said receiver includes two receiving channels and a control logic unit, wherein said control logic unit works according to the following table:

| Channel a | | Channel b | | C Logic | |
|---|---|---|---|---|---|
| PP1 | PM1 | PP2 | PM2 | Td | Alarm output |
| 1 | 1 | X | X | 1 | 0 |
| X | X | 1 | 1 | 1 | 0 |
| 0 | X | 0 | X | 1 | 1 |
| X | 0 | X | 0 | 1 | 1 |
| X | X | X | X | 0 | 1 |

where channels a and b correspond to the two receiving channels;

PP1=indicates a carrier frequency present on channel a;

PM1=indicates a correct modulation detected on channel a;

PP2=indicates a carrier frequency present on channel b;

PM2=indicates a correct modulation detected on channel b;

Td=indicates an ultrasonic signal received within a given time;

1=stands for present;

0=stands for missing; and

X=stands for indifferent.

* * * * *